United States Patent [19]

Heitzig et al.

[11] Patent Number: 5,023,588

[45] Date of Patent: Jun. 11, 1991

[54] HOLDER FOR A TUBULAR SAFETY FUSE

[75] Inventors: Claus-Peter Heitzig, Pfaffenhofen/Glonn; Dietmar Schuetz, Germering, both of Fed. Rep. of Germany

[73] Assignee: Siemens Aktiengesellschaft, Berlin and Munich, Fed. Rep. of Germany

[21] Appl. No.: 581,374

[22] Filed: Sep. 12, 1990

[30] Foreign Application Priority Data

Aug. 14, 1990 [DE] Fed. Rep. of Germany ... 9011813[U]

[51] Int. Cl.[5] ..... H01H 85/02; H01H 85/46; H01R 13/68

[52] U.S. Cl. ..... 337/195; 337/188; 439/622

[58] Field of Search ..... 337/186–198, 337/199, 201; 439/621, 622, 620

[56] References Cited

U.S. PATENT DOCUMENTS 3,659,252 4/1972 Brown ..... 337/196
4,762,509 8/1988 Schaefer ..... 439/621

*Primary Examiner*—Harold Broome
*Attorney, Agent, or Firm*—Hill, Van Santen, Steadman & Simpson

[57] ABSTRACT

A holder for a tubular safety fuse providing an insulating ring that surrounds the safety fuse which prevents short circuits during removal of the fuse. It can occur that when the safety fuse blows, an axially displaceable contact piece which is wired to a first terminal welds to a back contact cap of the safety fuse. When the safety fuse is thereafter pulled, there is a risk that the back contact cap, adhering to the displaceable contact piece, will come into electrical contact with a middle contact which is wired to a separate terminal pin. If the first terminal pin and the separate terminal pin are at different electrical potentials a sparking can result. The insulating ring prevents this electrical contact between the back contact cap and the middle contact.

10 Claims, 1 Drawing Sheet

FIG 1
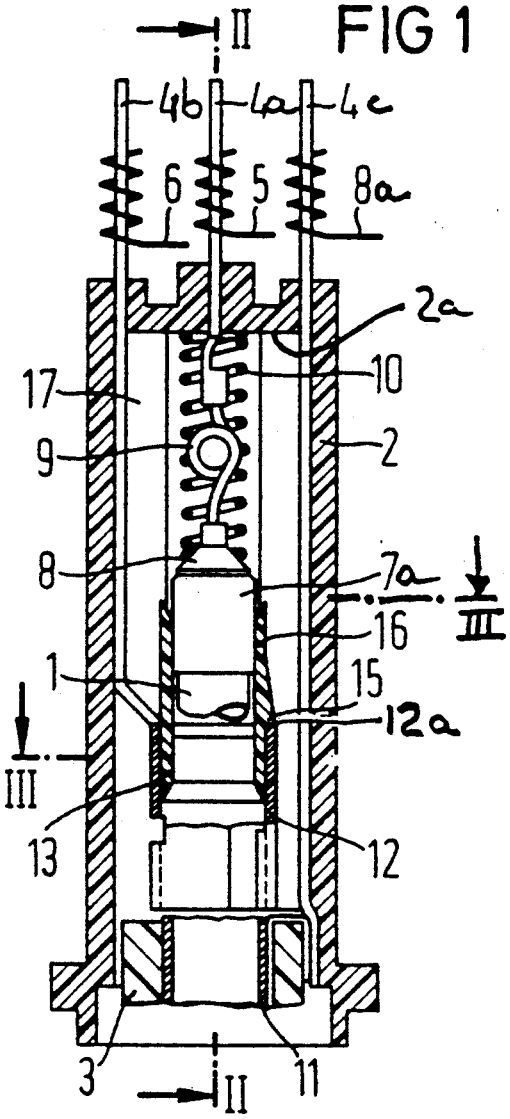
FIG 2
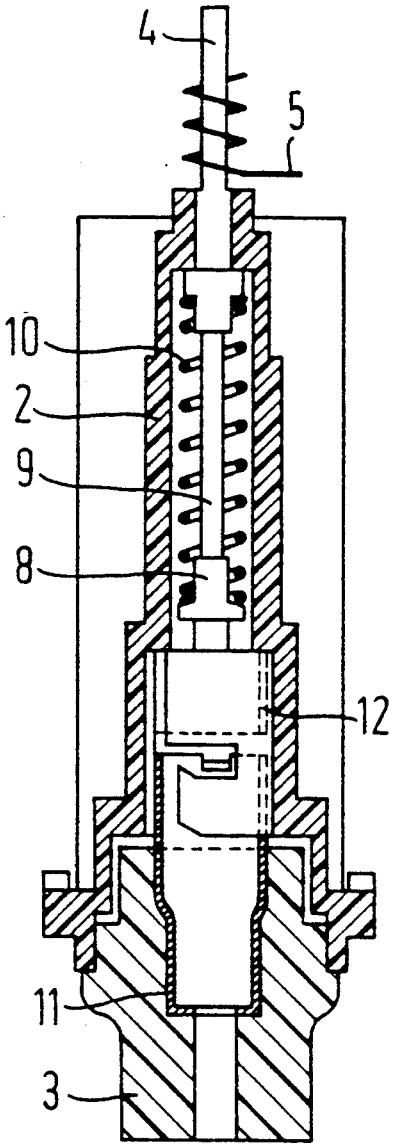
FIG 3
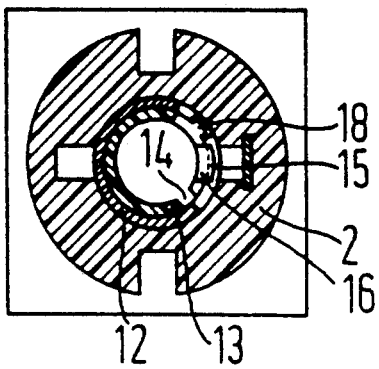
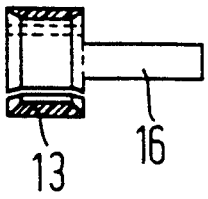
FIG 4

HOLDER FOR A TUBULAR SAFETY FUSE

BACKGROUND OF THE INVENTION

The invention is directed to a holder for a tubular safety fuse which has contact caps at opposite end faces. Such holders are known for fuses in power supply lines of telephone switching systems. A holder is composed of a back-side receptacle for the fuse and of a front-side closure cap. The receptacle at the back side comprises an axially displaceable contact piece that is resiliently pressed against the contact cap of the back side. A cooperating contact piece on the front side of the holder is anchored in the closure cap. The receptacle further comprises a tubular middle contact into which the cooperating contact piece, fashioned cylindrically, can be introduced in the fashion of a bayonet closure. The middle contact connected to an outgoing line is sufficiently long that it projects into the proximity of the contact cap at the back side.

The axially displaceable contact piece is resiliently mounted and secured to a stranded wire that is connected to a terminal pin at the back side for an incoming line. In order to increase the stranded wire's resiliency, it is wound into a loop. A helical compression spring surrounding the wire has its back end supported against the receptacle and presses the displaceable contact piece against the back contact cap of the fuse. When the fuse is removed, then the displaceable contact piece follows the fuse within the framework of the resiliency of the stranded wire. Before, however, the back contact cap reaches the middle contact, it separates from the contact piece so that a short to the middle contact cannot arise.

It has been shown, however, that an excess current that causes the fuse to blow effects a welding of the displaceable contact piece to the contact cap due to arc effects. When the fuse is then replaced, the stranded wire is stretched beyond its normal dimension, so that the displaceable contact piece does not break away from the back contact cap of the fuse until it has already reached the middle contact. In this case, a short with considerable sparking arises, as a result whereof the system could be jeopardized and maintenance personnel in close proximity could be startled. Such fuses, for example, are sometimes situated at the upper side of a switching rack and can usually only be reached with the assistance of ladders. In this case, the said effects could possibly contribute to a falling of an inattentive person changing the fuse.

SUMMARY OF THE INVENTION

The object of the invention is to fashion the holder such that the risk of a short-circuit is avoided.

This object is achieved by the invention of a holder for a tubular safety fuse (1) comprising contact caps (7) at each end, whereby a resiliently axially displaceable contact piece (8) is connected to an incoming line (5) and a fixed cooperating contact piece (11) is connected to an outgoing line (6), whereby the cooperative contact piece (8) is part of a front closure cap (3) of the holder, whereby the outgoing line (6) is connected to a tubular middle contact (12) that surrounds the safety fuse (1) and can be connected closure-like to the cooperating contact piece (11), and whereby the middle contact (12) has its backside projecting up into the proximity of the contact cap (7) connected to the displaceable contact piece (8), characterized in that a longitudinally slotted insulating ring (13) that surrounds the safety fuse (1) and separates it from the middle contact (12) can be introduced into that section of the middle contact (12) that remains free of the cooperating contact piece (11); and in that the insulating ring (13) comprises at least one catch nose (15) that engages behind the back end face of the middle contact (12).

The insulating ring is fashioned such that it covers a back region of the middle contact in the direction toward the back contact cap. As a result thereof, the latter can no longer touch the middle contact even in the worst case. The risk of shorts is thus reliably avoided. The longitudinal slot formed in the insulating ring makes it possible to make this ring sufficiently resilient that it can be subsequently introduced into a holder that has already been manufactured or that is already integrated into a rack. As a result of the longitudinal slot, the ring's diameter can be reduced to such an extent that the catch nose can also be thrust through the middle contact. This catch nose is situated in an angular position in which it projects into a clearance of the receptacle fashioned like a longitudinal slot or clearance, so that no collisions whatsoever with the receptacle derive. An advantageous, outer longitudinal rib at the insulating ring thereby engages into a mating longitudinal slot of the middle contact and thus secures the insulating ring against turning during insertion, so that the catch nose reaches its proper angular position.

The inside diameter of the insulating ring is somewhat larger than the outside diameter of the back contact cap, so that it can be easily pushed through.

In a development of the invention, two axially parallel guide fingers for the fuse are attached to the back of the insulating ring and one of the guide fingers is arranged as an extension of the catch nose. The guide fingers are arranged such that they project into the longitudinally directed clearances of the receptacle. They embrace the back contact cap in their function position, so that the contact cap is held in a defined position. The insulating ring is also provided with introduction bezels for the contact cap at its front side.

The invention shall be set forth in greater detail below with reference to an exemplary embodiment of the invention shown in the drawings.

BRIEF DESCRIPTION OF THE DRAWINGS

FIG. 1 is a longitudinal section through a holder for a tubular safety fuse and an insulating ring;

FIG. 2 is another longitudinal section through the holder generally along the line II—II of FIG. 1 without the longitudinal fuse and the insulating ring;

FIG. 3 is an offset cross-section through the holder generally along the line III—III of FIG. 1; and FIG. 4 is an axial longitudinal section through the insulating ring of FIG. 3.

DETAILED DESCRIPTION OF THE PREFERRED EMBODIMENTS

According to FIGS. 1 through 4, a holder for a tubular safety fuse 1 is composed of a back receptacle 2 and of a front closure cap 3. Terminal pins 4*a*, 4*b* for an incoming line 5 and an outgoing line 6 respectively are arranged at the back side of the holder, the terminal pins 4*a*, 4*b* being connected to a back contact cap 7*a* and a front contact cap 7*b* (not shown) respectively of the safety fuse 1. A signalling line 8*a* that leads to a display means (not shown) at which an outage of the safety fuse 1 is displayed is connected to a third terminal pin 4*c*.

The receptacle 2 comprises an axially displaceable contact piece 8 that is connected to the terminal pin 4*a* for the incoming line 5 via a stranded wire 9 wound into a loop. A helical compression spring 10 is pushed over this stranded wire 9 and is supported against a back wall 2*a* of the receptacle 2 and has its other end supported at the contact piece 8. The front contact cap 7*b* (not shown) of the safety fuse 1 is thereby pressed against the cooperating contact piece 11 that is secured in the front closure cap 3 and projects tubularly therefrom.

The receptacle 2 further comprises a likewise tubular middle contact 12 into which the cooperating contact piece 11 engages in contacting fashion and which is connected to the terminal pin 4*b* for the outgoing line 6. The middle contact 12 projects into the proximity of the back contact cap 7*a*. The cooperating contact piece 11 and the middle contact 12 are fashioned like a bayonet closure and are latched to one another secure against axial dislocation.

The characteristic of the helical compression spring 10 and the stiffness of the stranded wire 9 are dimensioned such that the back contact cap 7*a* lifts off from the contact piece 8 when the closure cap 3 is loosened and disengaged, lifting off therefrom before it reaches the middle contact 12. In the case of an excess current that leads to the blowing of the fuse, however, it can occur that the back contact cap 7*a* welds to the contact piece 8 as a consequence of arc effects. When the safety fuse 1 is pulled out, the contact piece 8 then adheres to the back contact cap 7*a* and is pulled along to such an extent that the back contact cap 7*a* is pulled into the region of the middle contact 12 before the contact piece 8 breaks free.

An insulating ring 13 is introduced into the middle contact in the extension of the cooperating contact piece 11, this insulating ring 13 being arranged between the safety fuse 1 and the middle contact 12 and preventing a direct contact of the back contact cap 7*a* with the middle contact 12 before the breaking of the contact piece 8 from the back contact cap 7*a*. The insulating ring 13 comprises a longitudinal slot 14 and a catch nose 15 that engages behind the middle contact 12 at its back side edge 12*a* and thus prevents the insulating ring 13 from being pulled back out from the receptacle 2. The longitudinal slot makes it possible to compress the insulating ring to such an extent while being introduced into the middle contact 12 that the catch nose 15 can also be plugged through without damage. It thereby becomes possible to retrofit finished holders built into switching systems with the insulating rings 13.

The inside diameter of the insulating ring 13 is dimensioned such that the safety fuse 1 can be pushed therethrough with little play.

Axially parallel guide fingers 16 that are attached to the insulating ring 13 at a back side thereof (a side toward the back wall 2*a*) surround the back contact cap 7*a* of the introduced safety fuse 1 so that the latter is precisely aligned to the contact piece 8. The guide fingers 16 are arranged such that they project into longitudinally directed clearances 17 for the terminal pins 4*b*, 4*c*. One of the guide fingers 16 and the catch nose 15 are joined to one another of one piece in a space-saving fashion. The insulating ring 13 also comprises an outer longitudinal rib 18 that projects into a longitudinal slot of the middle contact 12 and thereby secures the insulating ring 13 in its angular position upon insertion into the middle contact 12, so that the catch nose 15 and the guide fingers 16 can be introduced without difficulty into the clearances 17.

Although the present invention has been described with reference to a specific embodiment, those of skill in the art will recognize that changes may be made thereto without departing from the scope and spirit of the invention as set forth in the appended claims.

We claim as our invention:

1. A holder arrangement for a tubular safety fuse, the tubular safety fuse having a first contact cap at one end and a second contact cap at an opposite end, comprising:

a front closure cap, a receiving member, providing a cavity for receiving the fuse therein, said receiving member engageable with said front closure cap to hold said fuse into said cavity, a first contact piece mounted resiliently to said receiving member, axially displaceable along an axis of installation of said tubular safety fuse into said cavity, said first contact piece abutting said first contact cap when said fuse is installed into said cavity, a second contact piece mounted to said front closure cap, said second contact piece abutting said second contact cap when said fuse is installed into said cavity and said front closure cap is engaged to said receiving member, a tubular middle contact mounted inside said cavity and surrounding said safety fuse when installed, and electrically contactable with said second contact piece upon closure of said front closure cap, said middle contact having a backside region projecting toward said first contact cap, an insulating ring mounted inside said cavity and surrounding said safety fuse, and separating said safety fuse from said middle contact, said insulating ring having a longitudinal slot and a catch nose, said longitudinal slot providing flexibility to compress a diameter of said insulating ring to pass said insulating ring with said catch nose through said tubular middle contact, said catchy nose springing behind a back end edge of said middle contact to prevent retraction of said insulating ring once installed, a first electrical line connected to said first contact piece providing an electrical connection to said safety fuse, and a second electrical line connected to said middle contact and providing a second electrical connection to said safety fuse.

2. A holder arrangement according to claim 1, wherein said insulating ring further comprises two axially parallel guide fingers mounted to said insulating ring at a backside thereof toward said first contact piece, said catch nose mounted on one of said guide fingers.

3. A holder arrangement according to claim 2, wherein said middle contact comprises a second longitudinal slot and said insulating ring further comprises a longitudinal rib, said longitudinal rib slidably residing in said second longitudinal slot when said insulating ring is installed into said middle contact, said rib and said second longitudinal slot providing for select axial rotational position of said insulating ring with respect to said middle contact.

4. A holder arrangement according to claim 1, wherein said receiving member comprises:

a receptacle having a back end wall, circumscribing side walls, a first terminal, and a second terminal, said first terminal electrically connected to said first electrical wire, said second terminal electrically connected to said second electrical wire, said terminals providing electric hook-ups external to said receptacle, said first contact piece springingly biased off of said back nd wall toward said first contact cap by a helical spring, said first electrical wire provided with a curl for axial flexibility, said helical spring provides a force for a clamping of said safety fuse between said first contact piece and said second contact piece; and said second contact piece is fashioned as a cup with said safety fuse held therein and projecting thereout, and closing of said front closure cap to said receptacle brings said safety fuse residing in said second contact piece into resilient engagement between said first and second contact pieces.

5. A holder arrangement according to claim 4, wherein said second contact piece is engageable into said middle contact utilizing a bayonet-style engagement.

6. A holder arrangement according to claim 1, wherein said insulating ring further comprises a plurality of axially parallel guide fingers for guiding insertion of said safety fuse toward said first contact piece.

7. A holder arrangement according to claim 6, wherein said receiving member comprises structure for supporting said first and second electric wire, said first contact piece, and said middle contact, said structure defining longitudinal clearances within said receiving member, and said plurality of said guide fingers, when said ring is properly axially rotationally oriented, slideably fit into said longitudinal clearances;

said middle contact comprises a second longitudinal slot;

and said insulating ring comprises a longitudinal rib engageable in said second longitudinal slot when said insulating ring is installed into said middle contact, and said proper axial rotational orientation of said ring is guaranteed by said longitudinal rib guided by said second longitudinal slot.

8. A holder arrangement according to claim 7, wherein one of said guide fingers comprises a catch nose portion which engages a back edge of said middle contact preventing retraction of said ring out of said middle contact.

9. A holder arrangement according to claim 8, wherein said receiving member comprises:

a receptacle having a back end wall, circumscribing side walls, a first terminal, and a second terminal, said first terminal electrically connected to said first electrical wire, said second terminal electrically connected to said second electrical wire, said terminals providing electric hook-ups external to said receptacle, said first contact piece springingly biased off of said back end wall toward said first contact cap by a helical spring, said first electrical wire provided with a curl for axial flexibility, said helical spring provides a force for a clamping of said safety fuse between said first contact piece and said second contact; and said second contact piece is fashioned as a cup with said safety fuse held therein and projecting thereout, and closing of said front closure cap to said receptacle brings said safety fuse residing in said second contact piece into resilient engagement between said first and second contact pieces.

10. A holder arrangement according to claim 9, wherein said second contact piece is engageable into said middle contact utilizing a bayonet-style engagement.

* * * * *